US005224170A

United States Patent [19]

Waite, Jr.

[11] Patent Number: 5,224,170

[45] Date of Patent: Jun. 29, 1993

[54] TIME DOMAIN COMPENSATION FOR TRANSDUCER MISMATCH

[75] Inventor: James W. Waite, Jr., Everett, Wash.

[73] Assignee: Hewlett-Packard Company, Palo Alto, Calif.

[21] Appl. No.: 685,370

[22] Filed: Apr. 15, 1991

[51] Int. Cl.[5] ..... H04R 3/00

[52] U.S. Cl. ..... 381/92; 381/96; 381/97; 364/553; 364/724.19

[58] Field of Search ..... 381/92, 96, 97; 364/553, 724.19

[56] References Cited

U.S. PATENT DOCUMENTS 4,306,113 12/1981 Morton ..... 381/58
4,741,038 4/1988 Elko et al. ..... 381/92
5,058,170 10/1991 Kanamori et al. ..... 381/92

OTHER PUBLICATIONS

Phan, T. M., "Sound Intensity Probe Calibration-State of the Art," Conference Proceedings, Inter-noise 88, pp. 119-122.

Ren, M. et al., "A Simple Technique for Improving the Performance of Intensity Probes," Noise Control Engineering Journal, vol. 38, No. 1, pp. 17-25.

Nielsen, T. G., "A Field Calibrated Real Time System For Intensity Measurements," Conference Proceedings, Inter-noise 88, vol. 38, No. 1, pp. 17-25.

Technical Review, A Brüel & Kjaer Publication, No. 4-1985, pp. 12-17.

Elliott, et al., "The Adaptive Equalisation of Microphone Responses," Test and Transducer Conference, Wembley, Oct. 28-30, 1986.

*Primary Examiner*—Jin F. Ng
*Assistant Examiner*—Edward Lefkowitz

[57] ABSTRACT

A two channel real time octave analyzer is equipped with an adaptive time domain phase compensation filter whose poles and zeros are programmably selected to counteract phase error associated with any given pair of microphones. Precise matching of microphone phase characteristics is thereby achieved. In the preferred embodiment, the transfer function for the adaptive filter is determined using a pole/zero synthesis technique based on cross spectrum data acquired in an FFT spectral analysis of the probe microphones.

24 Claims, 4 Drawing Sheets

TIME DOMAIN COMPENSATION FOR TRANSDUCER MISMATCH

FIELD OF THE INVENTION

The present invention relates to a method and apparatus for precisely matching the characteristics of a pair of transducers, such as microphones, for measurement applications.

BACKGROUND AND SUMMARY OF THE INVENTION

For expository convenience, the present invention is illustrated with reference to the matching of characteristics of microphones used in a probe for measuring sound intensity. It should be recognized, however, that the invention can advantageously be applied in a number of other situations requiring precise matching of phase and/or amplitude characteristics.

Sound intensity is a vector measurement of the average rate of sound energy transmitted in a specified direction through a unit area normal to this direction at a specific point. Such measurements are commonly used to quantify, for example, the noise emitted from industrial equipment or machinery.

Sound intensity measurements are conventionally made using a pair of precisely matched, closely spaced microphones (commonly known as a sound intensity "probe"). As explained more fully in Pope, J., "The Two-Microphone Sound Intensity Probe," Journal of Vibration, Stress, and Reliability in Design, Vol. 110, January, 1988, pp. 97–103, sound intensity is related to the cross-spectrum detected by the two microphones in the frequency domain according to the following formula:

$$I_r(\omega) = -Im(G_{AB})/\pi\omega\Delta r \quad (1)$$

The equivalent expression in the time domain is:

$$I_r = \frac{-(p_a + p_b)_t \int (p_b - p_a)dt}{2\rho\Delta r} \quad (2)$$

where:

$\pi$ is the density of the acoustic medium;

$\omega$ is the frequency in radians;

$\Delta r$ is the effective microphone separation;

$p_a$ is the sound pressure at microphone a;

$p_b$ is the sound pressure at microphone b;

$I_r$ is sound intensity in direction r from a to b; and $Im(G_{AB})$ represents the imaginary part of the cross-spectrum between $p_a$ and $p_b$.

The measurements necessary to make the above-detailed calculations can be performed using two different types of instruments: Fast Fourier Transform (FFT) spectrum analyzers and real time octave analyzers. Each has its respective advantages and disadvantages.

An FFT analyzer, such as the Hewlett-Packard HP 35660A and 35665A, operates by digitally sampling an analog input signal and performing a fast Fourier transform on the sampled data to determine its spectral composition. The results of the Fourier analysis are a series of spectral coefficients, one corresponding to each of a plurality of frequency "bins."

A drawback of the FFT analyzer technique is that the frequency bins into which the Fourier analysis resolves the spectral composition are uniformly spaced in frequency. A 400 bin analysis of the spectrum between 0 and 10 KHz, for example, results in bins that each correspond to 25 Hz. While such resolution is more than adequate for higher frequencies, it is inadequate at low frequencies.

To provide adequate resolution at low frequencies, a second FFT measurement spanning a smaller range (such as 0–1 KHz) is generally required. The results of the two measurements are then combined to yield a final result. This procedure, however, is problematical since a single instrument cannot make both measurements at the same time. The combined measurement instead reflects two different measurements made at two different times. This non-real time operation is often unacceptable.

Real time octave analyzers, in contrast, use a series of bandpass filters (often implemented digitally in a sampled data system) to determine spectral composition. These filters are generally centered at logarithmically-spaced frequencies (often in one-third octave steps), thereby providing increasingly finer resolution at increasingly lower frequencies.

(The human ear perceives sound in a logarithmic fashion, making octave-based analysis a popular mode of measurement. Further, most acoustic standards, such as the IEC 1043 Instruments for the Measurement of Sound Standard, are specified in this fashion.)

Several real time octave analyzers are known, including the Bruel & Kjaer 2133 and the HP 35665A. (The HP 35665A, which was noted above as an FFT analyzer, combines FFT and real time octave analysis capability in a single instrument.) In the B&K 2133, sound intensity is calculated by combining the outputs of the bandpass filters to perform a sampled data counterpart to the operation described in equation (2) above.

In order for the cross-channel data acquired in either an FFT or real time octave analyzer measurement setup to be useful, the characteristics of the probe microphones must be precisely matched. Amplitude matching is relatively easy to obtain. (Further, the sound intensity calculation is less sensitive to amplitude mismatch. Cf. Pope, supra.) Phase matching, however, is difficult.

Two primary mechanisms contribute to phase mismatches between otherwise identical microphones. The first relates to variability in diaphragm damping. This phenomenon is particularly evidenced at frequencies above a few hundred Hz. Due to manufacturing tolerances, otherwise identical microphones may commonly exhibit a difference in phase response of several degrees when measured at one kilohertz.

The second mechanism that contributes to microphone phase mismatch is an interaction between a cavity behind the microphone diaphragm and a hole venting this cavity to the atmosphere, effectively creating an acoustical low pass filter. Differences in this static pressure equalization between microphones can cause a phase variance between otherwise matched microphones of up to three degrees at twenty hertz. (Twenty hertz is typically the low frequency limit for sound intensity measurements.)

In order for a pair of microphones to be successfully utilized for sound intensity measurements, their phase characteristics should generally be matched to within less than 0.3 degrees throughout the measurement span of interest. (This 0.3 degree figure is highly application dependent. In some instances a variance of up to 1 degree may be acceptable. In others, a variance of less than 0.1 degrees may be required.). As noted, current manufacturing processes can only reliably match microphones to within about 3 degrees, an order of magnitude higher than this approximate threshold requirement. Accordingly, microphones must generally be matched by a tedious manual selection process.

Low frequency phase error is usually the most critical in making sound intensity measurements. As noted, sound intensity is a vector measurement. The direction of the measured sound is determined by the phase delay with which the same sound reaches the two microphones. Since, at low frequencies, the sound wavelength is several meters long, and the microphones may only be spaced by a centimeter or two, the cos $\phi$ phase delay associated with off-axis sound vectors is quite small and would be masked by even small phase errors ($\phi$ is here the angle between the intensity vector and the center line of the microphones).

If the problem of low frequency phase error could be solved, the remaining task of selecting microphones by manually matching high frequency responses would be considerably simplified.

While in real time octave analyzers, the microphones themselves must be precisely matched, in FFT analyzers it is possible to match the microphones using correction factors internal to the analyzer. In particular, it is possible to determine the phase error between a pair of microphones in the frequency domain, and then multiply the cross spectrum between the microphones by the complex conjugate of this error term to effect correction. This method has been used for many years in FFT instruments.

(To determine the phase error between a pair of microphones, a number of different methods may be employed. Exemplary are those disclosed in Chung, J. Y., "Cross-Spectral Method of Measuring Acoustic Intensity Without Error Caused by Instrument Phase Mismatch," Journal of the Acoustical Society of America, Vol. 64, No. 6, 1978, pp. 1613–16, and Seybert, A. F., "Measurement of Phase Mismatch Between Two Microphones," NOISE-CON 85 Proceedings, 1985, pp. 423–28.)

Real time octave analyzers have not previously been susceptible to this type of phase correction. Consequently, extensive research has been conducted in methodologies of producing closely matched microphones. Exemplary of this work are: Frederiksen, E., "Phase Characteristics of Microphones for Intensity Probes,"-Proceedings of 2nd International Congress on Acoustic Intensity, Senlis, 1985, pp. 50–57; and Frederiksen, E., et al, "Pressure Microphones for Intensity Measurements with Significantly Improved Phase Properties," Bruel & Kjaer Technical Review, No. 4, 1986, pp. 11–21. The latter paper proposed a solution to low frequency phase mismatch by mechanical compensation—namely the addition of two additional cavities behind the diaphragm to attenuate the effect of low frequency vent-cavity resonances, and hence minimize phase variabilities between microphones. Microphones optimized for phase accuracy are also shown in U.S. Pat. Nos. 4,887,300 and 4,777,650. While effective, such approaches result in significantly increased manufacturing costs.

In accordance with the present invention, a real time octave analyzer is equipped with an adaptive time domain phase compensation filter whose poles and zeros are selected to counteract the low frequency phase error associated with any given pair of microphones. Precise equalization of unmatched microphone phase errors is thereby achieved without resort to elaborate mechanical compensation schemes. In the preferred embodiment, the transfer function for the adaptive filter is determined using a pole/zero curve fitting technique based on cross spectrum data acquired in an FFT spectral analysis of the probe microphones.

The foregoing and additional features and advantages of the present invention will be more readily apparent from the following detailed description, which proceeds with reference to the accompanying drawings.

DETAILED DESCRIPTION

Figure 1:
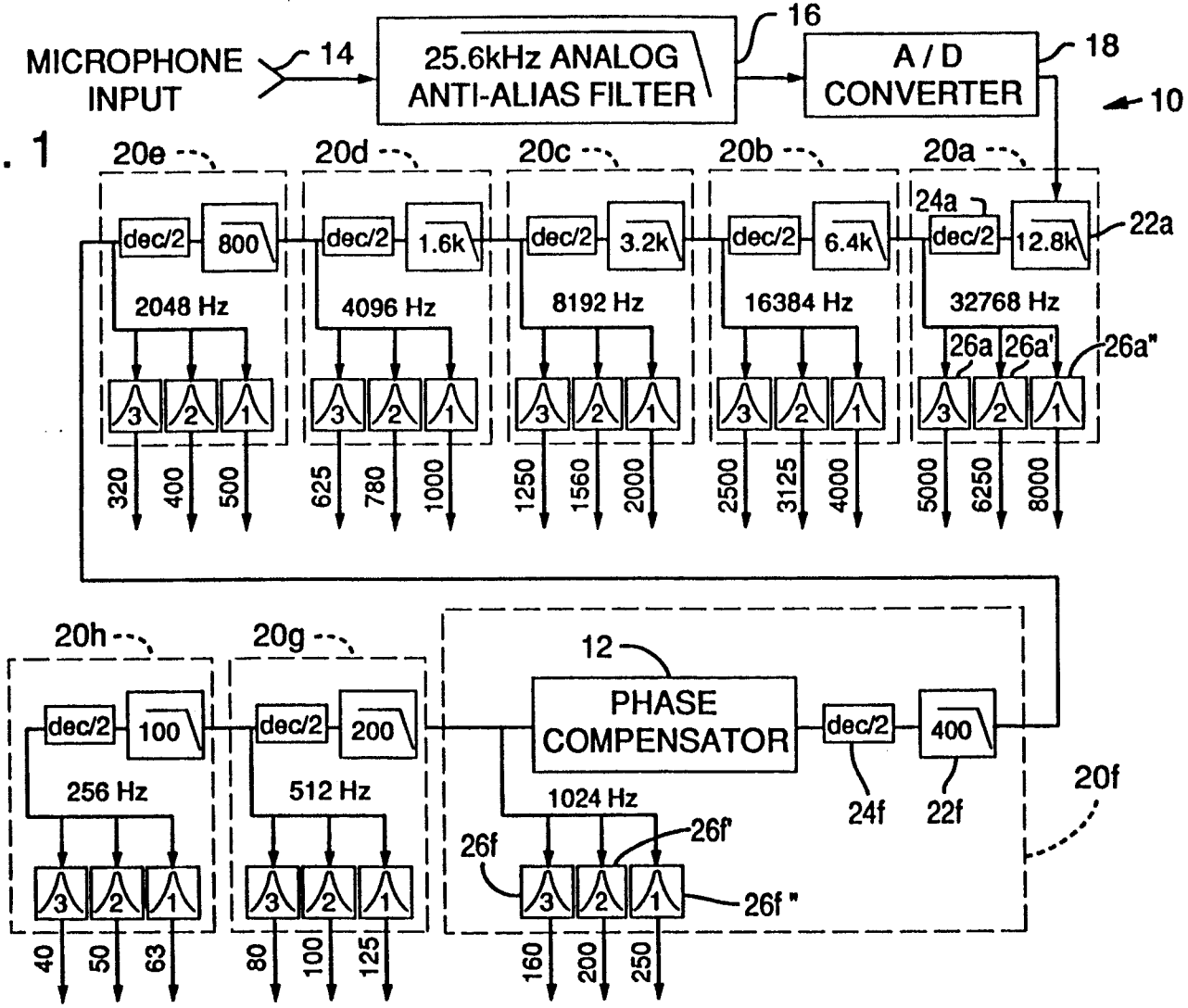
FIG. 1 is a schematic block diagram of a real time one-third octave analyzer according to one embodiment of the present invention.

Referring to FIG. 1, a one-third octave analyzer 10 according to the present invention includes two measurement channels A and B. Only channel A is illustrated. Channel B is identical except for the omission of a filter 12 detailed below.

Channel A includes a microphone 14, an analog anti-alias filter 16, an analog-to-digital (A/D) converter 18, and a series of analysis stages 20. Each analysis stage 20 includes a digital anti-alias low pass filter 22, a decimation stage 24, and three one-third octave digital bandpass filters 26/26'/26''.

The microphone 14 is one of two that comprise the sound intensity probe. The output from this microphone is low-pass filtered by the analog anti-alias filter 16 to attenuate spectral components above 25.6 KHz. This bandlimited signal is then sampled 65,536 ($2^{16}$) times per second by the A/D converter 18.

The sampled signal from the converter 18 is provided to the first analysis stage 20*a*, which low pass filters the incoming sampled data with filter 22*a* to attenuate components above 12.8 KHz. The filtered signal is then decimated by decimator 24*a*. (Decimation refers to a known process wherein periodic data samples not essential to fulfillment of the Nyquist criterion are ignored. Here, decimation permits all lower full-octave bands to be analyzed with the computational power that would normally be required to analyze a single octave at the original 65.536 KHz sample rate.)

The decimated output signal (now consisting of 32,768 samples/second) is applied to the three digital bandpass filters 26*a*, 26*a'* and 26*a''* (ANSI Std. S1.11 1986 order 3, type 1-D filters), which resolve the sampled spectra into one-third octave bands centered at 8000, 6250, and 5000 Hz, respectively.

The output from the first decimator 24*a* provides the sampled data used by the second analysis stage, 20*b*. This data is again low pass filtered (this time at 6.4

KHz), decimated (to 16,384 samples/second), and provided to one-third octave digital filters 26b, 26b' and 26b'' centered at 4,000, 3,125, and 2,500 Hz respectively.

Fortuitously, since decimation halved the sample rate, and since the analysis bands are also related by two (per ANSI Std. S1.11-1986, base 2 system of digital one-third octave filters), the positions of the poles and zeros of filters 26b/26b'/26b'' are the same as those of filters 26a/26a'/26a''. This greatly facilitates implementation of the bandpass filters since the same set of three filters used in stage 20a is simply replicated in stage 20b.

Additional analysis stages 20c, 20d and 20e are similarly cascaded, one after another. Each low pass filters the input signal at half the prior filter frequency, decimates by two, and resolves the decimated data into the next three lower one-third octave bands. Again, decimation of the data, coupled with the halving of the analysis bands, permits the same set of three filters to be used in each successive stage.

Analysis stage 20f includes a filter 12 not found in the other analysis stages, nor found in the other measurement channel ("B"). The illustrated filter 12 is an adaptive, unity gain, time domain, infinite impulse response (IIR) filter whose purpose is to counteract phase errors associated with the probe microphones 14 at frequencies below 300 Hz. The particular manner in which the poles and zeros of this filter are determined is detailed below and illustrated with reference to FIGS. 2–4.

First, the phase error between the two probe microphones is determined. A suitable method is described by Chung, supra. Chung's method basically is a circuit switching technique wherein the cross spectrum is measured once (yielding a measured spectrum $G_{AB}$ and then measured again with the microphones switched (yielding a measured spectrum $G^S_{AB}$). The switching permits the phase response due to actual intensity to cancel upon division, leaving just the probe phase error term in the following equation:

$$e^{j\theta e}=(G_{AB}/G^{S*}_{AB})^{\frac{1}{2}} \quad (3)$$

where $e^{j\theta e}$ is the phase error as a function of frequency; and $G^{S*}_{AB}$ is the complex conjugate of $G_{sAB}$.
Similarly, the phase error cancels upon the multiplication of $G_{AB}$ and $G^{S*}_{AB}$, yielding an estimate of the cross-spectrum which is devoid of errors due to the phase mismatch. This estimate would then be inserted in equation (1).

Figure 2:
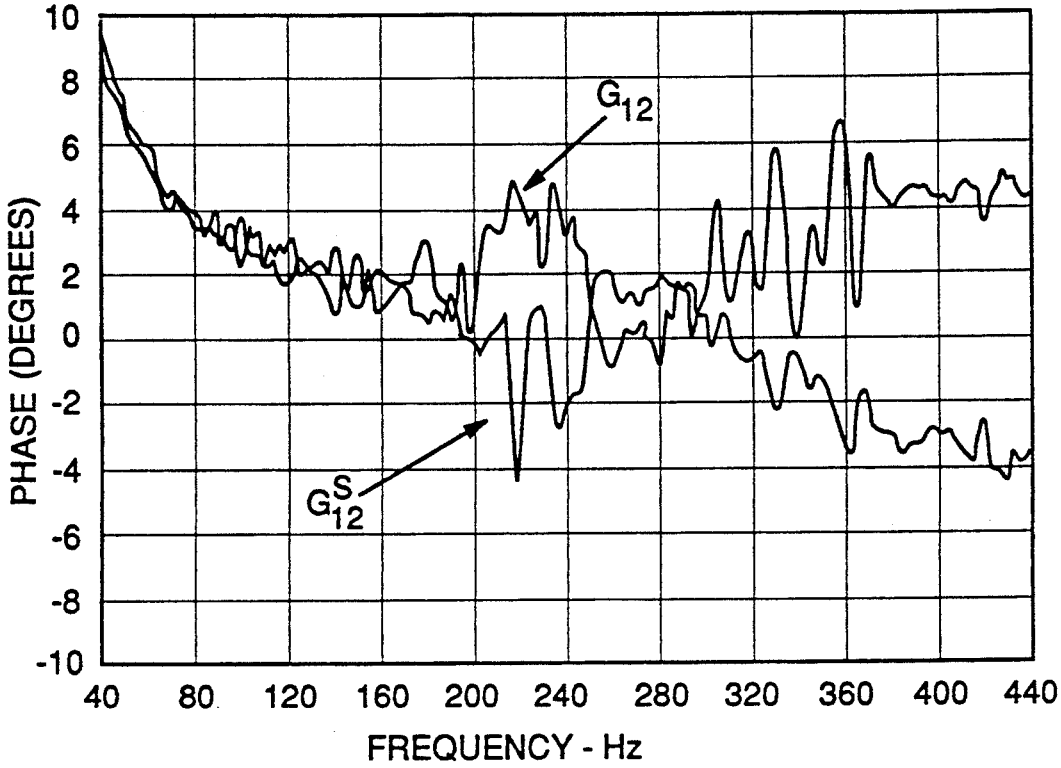
FIG. 2 is a plot showing a cross spectrum of pink noise sampled by a pair of unmatched microphones in a reference state and in a switched state as a function of frequency.
Figure 3:
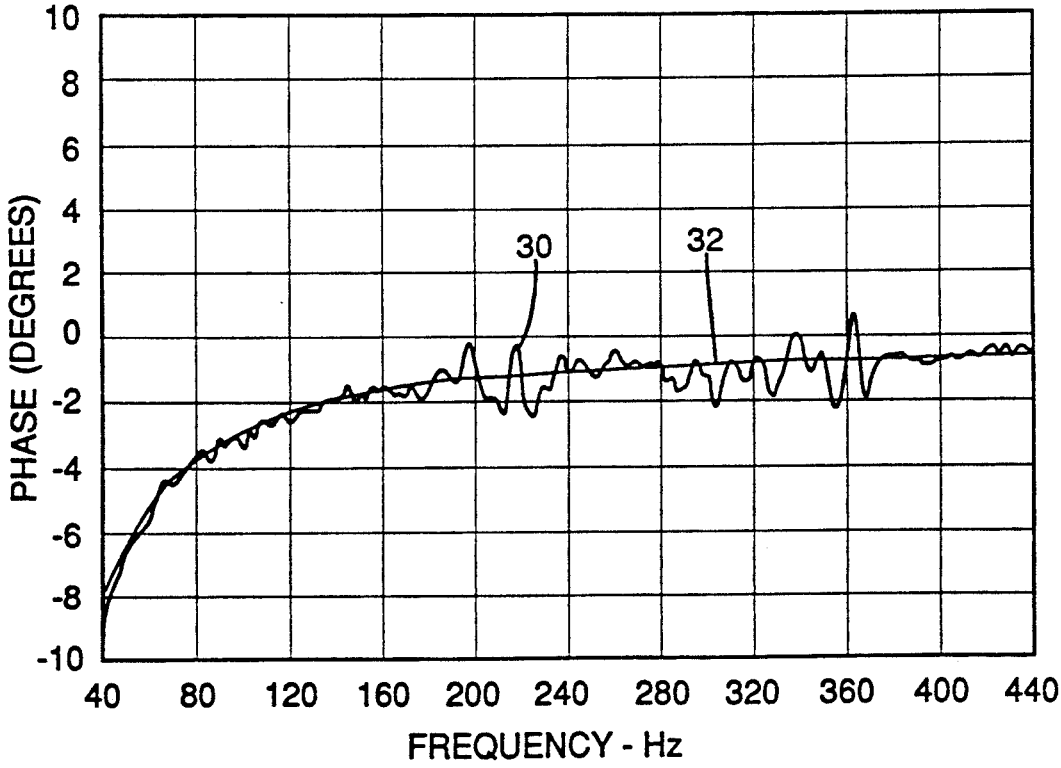
FIG. 3 is a plot of the microphone phase error determined from FIG. 2, and a correction curve synthesized with three poles and three zeroes.

FIG. 3 shows, by the curve 30, the conjugate result of this calculation for the $G_{AB}$ and $G^S_{AB}$ data shown in FIG. 2. The conjugate of the error phase is used as a basis for the correction filter 12.

It is possible to synthesize a correction filter transfer function that is arbitrarily close to curve 30. Curve 32 in FIG. 3 shows a transfer function synthesized using three poles and three zeros. Such an approximation is adequate for most applications.

The methodology used to synthesize a time domain filter transfer function from data such as that represented by curve 30 has been known in the art for many years and is illustrated, for example, in U.S. Pat. Nos. 4,654,808, 4,654,809 and 4,658,367, the disclosures of which are incorporated herein by reference. In the best mode, the Chung microphone phase error measurements are made on a HP 3563A FFT analyzer that has the built-in capability to fit a synthesized S-domain transfer function to an arbitrary curve using the methodology disclosed in these patents.

The output of the curve fitting process are data representing the poles and zeros of the synthesized transfer function.

In some instances, the curve-fitting methodology described in the above-mentioned patents and implemented in the HP 3563A analyzer may result in poles at the right hand side of the S-plane, making the resulting filter unrealizable. To avoid this result, it has been found helpful to fix, a priori, one of the poles at 0 Hz (DC). (Further a priori placement of poles and zeros can aid in generating uniform gain factors from the curve fitting process. A physical justification for choosing additional fixed pole locations may be found in the cutoff frequency of the acoustical low pass filter created by the microphone vent-cavity interaction.)

In the illustrated embodiment, with one of the poles constrained to the origin of the S-plane, the pole/zero synthesis function yielded the following poles and zeros (each of which here lies lie along the real S-axis):

| POLES | ZEROS |
|---|---|
| 0 | −0.8962 |
| −1.1 | −6.0 |
| −135 | −132.33 |

The HP 3563A normally determines the synthesized transfer function in the S plane. However, conversion into the Z-domain is straightforward using the bi-linear transform—a feature which is also implemented as an automated operation in the HP 3563A analyzer.

Using a pre-warp frequency of 200 Hz, the following pole-zero locations are obtained in the Z-domain:

| POLES | ZEROS |
|---|---|
| 1.0 | .958618 |
| .355575 | .364269 |
| .992283 | .993708 |

(Pre-warp refers to the frequency at Which the S- and Z-domain representations coincide.)

The filter transfer function in the Z-domain is represented by:

$$H(z)=\frac{A\prod_{r=1}^{3}(1-c_r z^{-1})}{\prod_{k=1}^{3}(1-d_k z^{-1})}=\frac{\sum_{r=0}^{3} b_r z^{-r}}{1-\sum_{k=1}^{3} a_k z^{-k}} \quad (4)$$

The pole-zero equation for H(z) can be written by setting c, equal to the zero locations and $d_k$ equal to the pole locations. Once in the Z-domain, the transfer function can be expanded into polynomial form. The polynomial coefficients of z can then be used to implement the synthesized correction filter in a configuration called canonic direct form II. Non-unity gain of the correction filter is scaled by a factor of A.

Figure 5:
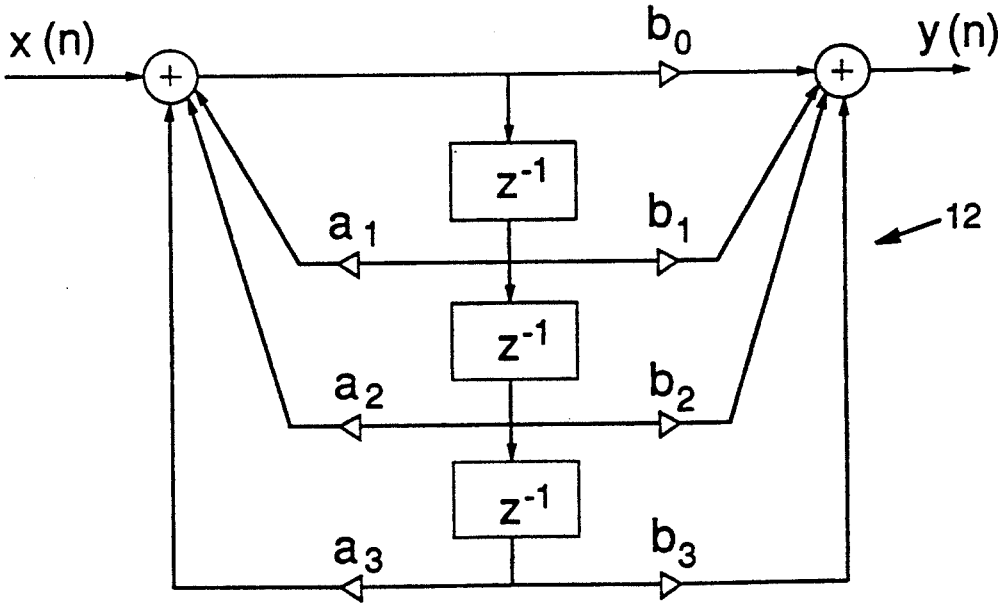
FIG. 5 is a block diagram of a canonic direct form II implementation of a time domain phase correction filter used in the analyzer of FIG. 1.
Figure 6:
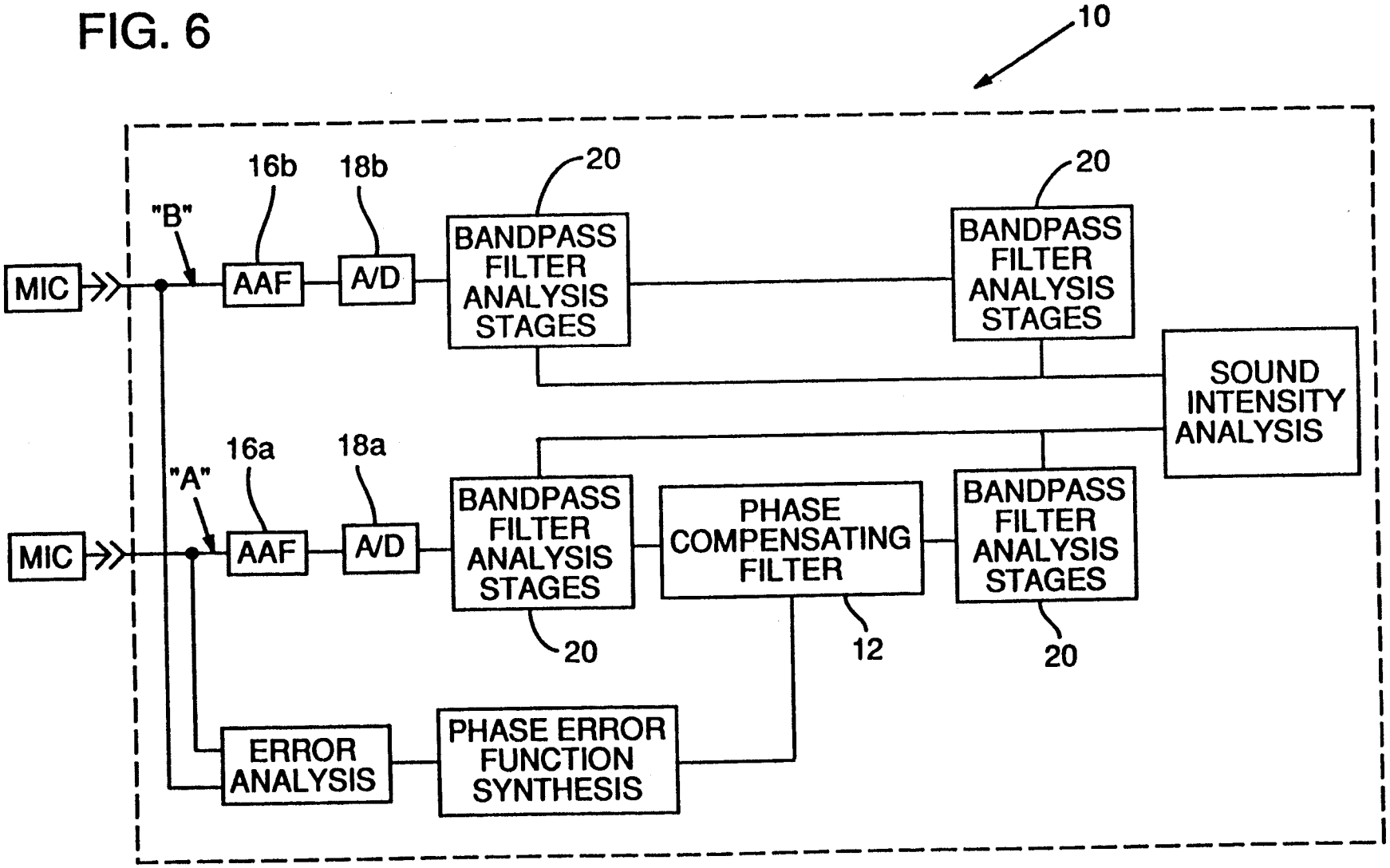
FIG. 6 is a schematic block diagram of a real time octave analyzer showing another possible embodiment of the present invention.

Such an implementation for the above-described filter is shown in FIG. 5 and will be recognized as an infinite impulse response (IIR) topology. In this example, the coefficients are real, although they need not be. The coefficients are also desirably reprogrammable, permitting the filter to be adapted to different microphones, or to track errors in a single set of microphones over time.

Figure 4:
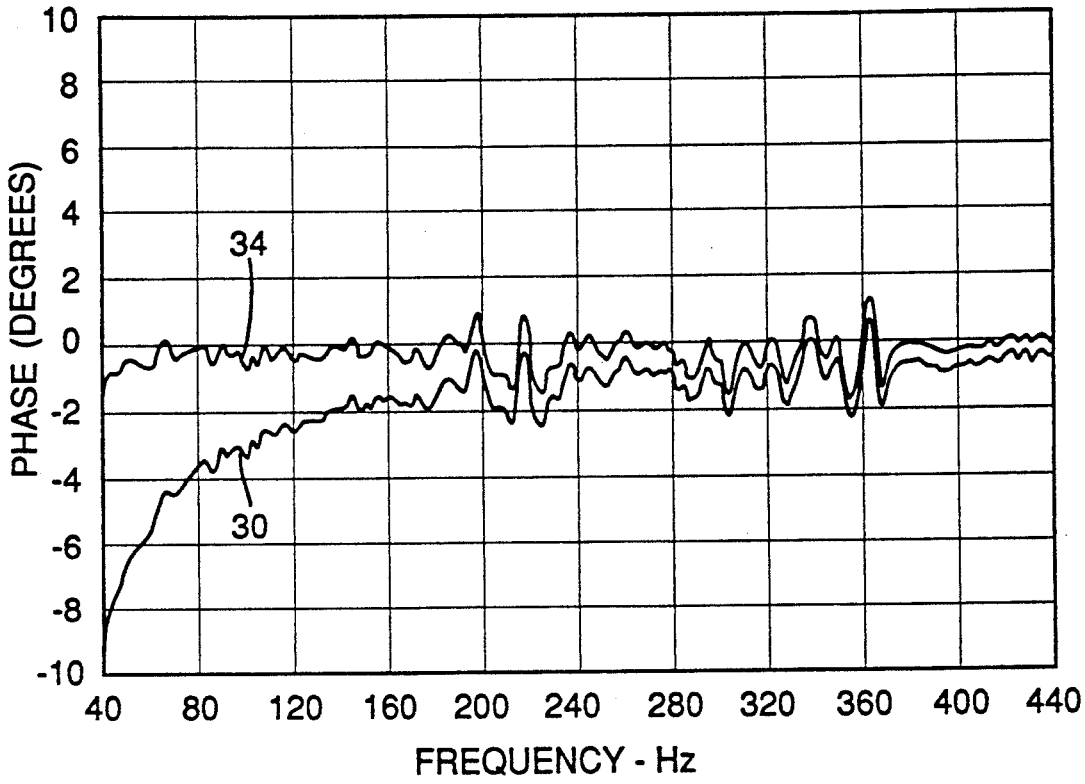
FIG. 4 is a plot of the microphone phase error after correction by the apparatus of FIG. 1.

FIG. 4 illustrates the probe phase error after correction by the time domain correction filter 12 (curve 34) and compares it with the phase error prior to correction (curve 30). As can be seen, the phase errors are greatly minimized.

(The curves of FIGS. 2–4 were obtained in a proof of concept measurement using randomly selected microphones in a non-anechoic environment. Error correction substantially in excess of that portrayed can be obtained in more controlled conditions.)

Returning to FIG. 1, the output from the correction filter 12 is provided to one-third octave filters 26f/26f'/26f'', which are centered at 250, 200 and 160 Hz, respectively. A cascaded arrangement like that described above then follows, with analysis stages 20g and 20h producing outputs for the bottom-most two octaves (125/100/80 Hz and 62.5/50/40 Hz).

To determine sound intensity, the outputs from the one-third octave bandpass filters 26/26'/26'' of channel A are combined with their counterparts of channel B in the conventional manner expressed by equation (2).

In the preferred embodiment, the analysis stages 20, including the time domain correction filter 12, are implemented using a general purpose digital signal processing circuit, such as the Motorola MC56001. In an alternative embodiment, the bandpass filters alone are implemented using a general purpose DSP circuit and the decimators 24 and low pass filters 22 of the analysis stages are implemented in a custom gate array.

In applicant's best mode, the above-described steps of microphone calibration and correction are integrated in an automated procedure that is programmed into a multi-channel FFT/real time octave analyzer instrument. Upon execution of this procedure, the instrument: provides microphone setup instructions to a user, provides a source of pink noise, acquires (in FFT mode) a first cross-spectrum, instructs the user to switch the microphones (assuming the Chung procedure is employed), acquires a second cross-spectrum (again in FFT mode), performs the operation of equation (3) to determine the phase error, synthesizes coefficients for a correction filter in accordance with the patented curve-fitting procedure, implements the correction filter in the real time octave analyzer architecture of FIG. 1, and then indicates to the user that the system has been calibrated and compensated and is ready to make sound intensity measurements. Data that is thereafter acquired by the calibrated system is processed in accordance with the sampled data counterpart of equation (2) to yield a real time sound intensity measurement.

Having described and illustrated the principles of my invention with reference to a preferred embodiment thereof, it will be apparent that the invention can be modified in arrangement and detail without departing from such principles. For example, while the invention has been illustrated with reference to a time domain correction filter optimized just for low frequencies, it will be recognized that the same principles permit compensation over an arbitrarily broad bandwidth. (More than three poles and zeros may be desirable in filters adapted to compensate the entire measurement band.) Similarly, while the invention has been illustrated with reference to an apparatus employing a single adaptive time domain correction filter, it will be recognized that in other embodiments, a plurality of such filters may advantageously be employed. Multiple serial correction filters may permit more precise tailoring of the phase correction curve. One filter may correct for higher frequency phase error (and have nil effect at low frequencies), and another filter may correct for lower frequency phase error. Alternatively, multiple filters may be used by interposing one between the decimator 24 and the filters 26/26'/26'' of each analysis stage 20, rather than serially in the chain of analysis stages. Still further, multiple filters may be used by placing one or more in each measurement channel, in which case it is the phase difference between the filter transfer functions that is effectively implemented.

While the invention has been illustrated with reference to a three pole/zero correction filter, it will be recognized that other filters may be found appropriate in other situations. For example, if the microphones are fairly closely matched, then a single term correction filter may suffice. Similarly, while the invention has been illustrated with reference to an S-domain curve fitter with a subsequent bi-linear transform to generate the Z-domain topology, in other embodiments the poles and zeros can be determined directly by a Z-domain curve fitter, such as that found in the HP 3563A. Finally, while the invention has been illustrated with reference to an adaptive IIR filter topology for the time domain correction filter, it will be recognized that other phase compensating filter topologies may readily be employed.

In view of the wide variety of embodiments to which the principles of my invention can be applied, it should be apparent that the detailed embodiment is illustrative only and should not be taken as limiting the scope of my invention. Rather, I claim as my invention all such modifications as may come within the scope and spirit of the following claims and equivalents thereto.

I claim:

1. In a method of time domain spectral analysis, an improvement comprising the steps:

determining an error characteristic sought to be compensated;

synthesizing a pole/zero transfer function approximating said error characteristic; and programming a time domain digital filter in accordance with said synthesized transfer function to compensate for the determined error characteristic.

2. A method of time domain spectral analysis according to claim 1 in which the transfer characteristic sought to be compensated is a phase error function associated with first and second measurement channels of a spectral analysis instrument, and in which the determining step comprises determining a phase error between said first and second channels.

3. The method of claim 2 in which the determining step includes switching the measurement channels to determine a phase error associated therewith.

4. The method of claim 2 in which the determining step further includes performing an FFT analysis of signals on the two channels.

5. The method of claim 1 in which the programming step comprises programming an infinite impulse response filter.

6. The method of claim 1 which further includes constraining a pole of the transfer characteristic to be located at DC.

7. The method of claim 1 in which the transfer characteristic sought to be compensated is a phase error function, and in which the time domain digital filter is programmed to correct for said phase error function.

8. A method of determining sound intensity comprising the steps:

determining a phase error function associated with signals from first and second microphones;

processing an output signal from the first microphone through a first series of bandpass filter stages to determine the spectral composition thereof, said processing including digital filtering with a first filter stage at a first sample rate and digital filtering with a second, subsequent filter stage at a second sample rate lower than the first;

processing an output signal from the second microphone through a second series of bandpass filters to determine the spectral composition thereof; and analyzing output signals from said first and second series of bandpass filters to determine sound intensity;

wherein at least the first of said processing steps further includes time domain digital filtering at a sample rate less than the first sample rate to correct for said determined phase error function so that the sound intensity determination resulting from the analyzing step is compensated for phase error without the need for post-analysis operation and at reduced computational expense due to the lower sampling rate.

9. The method of claim 8 in which the time domain filtering corrects for phase error function below 50 hertz.

10. The method of claim 8 in which the time domain filtering comprises filtering with an infinite impulse response filter.

11. The method of claim 8 which further includes:

synthesizing a transfer function approximating the conjugate of the determined error function; and programming a digital filter to implement said synthesized transfer function.

12. The method of claim 11 which further includes constraining a pole of the synthesized transfer function to near DC when synthesizing said transfer function.

13. The method of claim 12 in which the time domain filtering corrects for phase error function below 50 hertz.

14. A method of determining sound intensity comprising the steps:

determining a phase error function associated with signals from first and second microphones;

processing an output signal from the first microphone through a first series of bandpass filters to determine the spectral composition thereof;

processing an output signal from the second microphone through a second series of bandpass filters to determine the spectral composition thereof; and analyzing output signals from said first and second series of bandpass filters to determine sound intensity;

wherein at least one of said processing steps further includes time domain filtering to correct for said determined phase error function so that the sound intensity determination resulting from the analyzing step is compensated for phase error without the need for post-analysis operation, the method further including:

using a single measurement instrument:

perform FFT analyses of signals from the first and second microphones;

determine from said FFT analyses phase error function associated with said microphone signals;

synthesize a transfer function approximating the determined error function;

program a time domain digital filter to implement said synthesized transfer function; and compensate a digital data stream associated with the first microphone using said time domain digital filter.

15. The method of claim 14 which further includes using said same measurement instrument to perform FFT analyses of cross spectra using the microphones in reference and switched states, and determining from said cross spectra a phase error function associated with the microphone signals.

16. The method of claim 14 in which the time domain filtering corrects for phase error function below 50 hertz.

17. A real time octave analyzer having at least two measurement channels, each measurement channel comprising:

a source of input signals;

an anti-alias filter having an input coupled to the source of input signals;

an analog-to-digital converter having an input coupled to an output of the anti-alias filter;

a plurality of successive analysis stages, each having an input, an output, and at least one digital bandpass filter associated therewith, the digital bandpass filter producing an output signal responsive to sampled data provided thereto;

the input of a first analysis stage being coupled to an output of the analog-to-digital filter, the first analysis stage including a digital bandpass filter operating at a first sample rate;

the input of each successive analysis stage being coupled to an output of a previous analysis stage;

one of said measurement channels further including means for reducing the sample rate of data applied to subsequent analysis stages in said channel;

said one of said measurement channels further including a time domain digital filter operating on data at a sample rate less than the first sample rate, said time domain digital filter being adapted to compensate for a phase error associated with the source of input signals.

18. The analyzer of claim 17 in which the time domain digital filter is an infinite impulse response filter.

19. The analyzer of claim 17 in which the time domain digital filter is programmable so that it may be adapted to compensate for phase errors associated with a variety of input signal sources.

20. The analyzer of claim 17 which further includes FFT analysis means for characterizing the phase error associated with the source of input signals.

21. A real time octave analyzer having at least two measurement channels, each measurement channel comprising:

a source of input signals;

an anti-alias filter having an input coupled to the source of input signals;

an analog-to-digital converter having an input coupled to an output of the anti-alias filter;

a plurality of successive analysis stages, each having an input, an output, and at least one bandpass filter associated therewith;

the input of a first analysis stage being coupled to an output of the analog-to-digital filter;

the input of each successive analysis stage being coupled to an output of a previous analysis stage;

one of said measurement channels further including a time domain digital filter adapted to compensate for a phase error associated with the source of input signals;

wherein the time domain digital filter has a pole near DC.

22. A real time octave analyzer having at least two measurement channels, each measurement channel comprising:

a source of input signals;

an anti-alias filter having an input coupled to the source of input signals;

an analog-to-digital converter having an input coupled to an output of the anti-alias filter;

a plurality of successive analysis stages, each having an input, an output, and at least one bandpass filter associated therewith;

the input of a first analysis stage being coupled to an output of the analog-to-digital converter;

the input of each successive analysis stage being coupled to an output of a previous analysis stage;

one of said measurement channels further including a time domain infinite impulse response filter adapted to compensate for a phase error associated with the source of input signals.

23. A method of determining sound intensity comprising the steps:

determining a phase error function associated with signals from first and second microphones;

approximating the determined phase error function with a curve fitter;

determining pole and zero locations of a real time digital filter in accordance with said approximated phase error function;

processing an output signal from the first microphone through a first series of bandpass filters to determine the spectral composition thereof;

processing an output signal from the second microphone through a second series of bandpass filters to determine the spectral composition thereof; and analyzing output signals from said first and second series of bandpass filters to determine sound intensity;

wherein at least one of said processing steps further includes time domain filtering with a filter implemented in accordance with the determined pole and zero locations to correct for said determined phase error function.

24. A real time octave analyzer comprising a plurality of cascaded analysis stages, each of which includes a decimation stage, the analyzer further including a programmable time domain phase compensation filter interposed amidst said analysis stages.

* * * * *

UNITED STATES PATENT AND TRADEMARK OFFICE

CERTIFICATE OF CORRECTION

PATENT NO. : 5,224,170

DATED : June 29, 1993

INVENTOR(S) : James W. Waite, Jr.

It is certified that error appears in the above-identified patent and that said Letters Patent is hereby corrected as shown below:

Col. 1, l. 37 - delete "$Ir(\omega) = - Im(G_{AB}) / \pi\, \omega\Delta r$" and insert therefor -- $Ir(\omega) = - Im(G_{AB}) / \rho\, \omega\Delta r$--;

Col. 1, l. 44 - delete "$\pi$" and insert therefor --$\rho$--;

Col. 2, l. 5 - after "smaller" insert --frequency--;

Col. 5, l. 33 - after "$G_{AB}$" insert --)--;

Col. 5, l. 43 - delete "$G_{sAB}$" and insert therefor --$G^{S}_{AB}$--; and

Col. 9, l. 67 - before "phase" insert --a--.

Signed and Sealed this

Twenty-fifth Day of April, 1995

*Attest:*

Bruce Lehman

BRUCE LEHMAN

*Attesting Officer*

*Commissioner of Patents and Trademarks*